US009284676B2

(12) United States Patent
Choi et al.

(10) Patent No.: US 9,284,676 B2
(45) Date of Patent: Mar. 15, 2016

(54) DRUM TYPE WASHING MACHINE

(75) Inventors: Ji Hoon Choi, Hwaseong-si (KR); Phil Soo Chang, Seongnam-si (KR); Bong Wha Kwak, Hwaseong-si (KR); Jeong Hoon Kang, Seoul (KR); Hoon Wee, Yongin-si (KR); Tae Jin Park, Gimhae-si (KR); Sung Jin Cho, Yongin-si (KR); Sang Wook Kim, Suwon-si (KR); Gyu Sung Na, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1033 days.

(21) Appl. No.: 12/461,619

(22) Filed: Aug. 18, 2009

(65) Prior Publication Data

US 2010/0058816 A1 Mar. 11, 2010

(30) Foreign Application Priority Data

Sep. 9, 2008 (KR) ..... 10-2008-88837

(51) Int. Cl.
*D06F 37/02* (2006.01)
*D06F 37/26* (2006.01)
*D06F 37/20* (2006.01)

(52) U.S. Cl.
CPC ..... *D06F 37/26* (2013.01); *D06F 37/20* (2013.01)

(58) Field of Classification Search
CPC ..... D06F 37/02
USPC ..... 68/3 R
See application file for complete search history.

(56) References Cited

U.S. PATENT DOCUMENTS

| | | | | |
|---|---|---|---|---|
| 5,329,791 | A | 7/1994 | Cargnel et al. | |
| 6,502,433 | B1 * | 1/2003 | Uhlin | 68/24 |
| 2007/0137263 | A1 * | 6/2007 | Cho et al. | 68/140 |
| 2008/0178635 | A1 * | 7/2008 | Ratfisch | 68/140 |
| 2008/0178636 | A1 | 7/2008 | Lee et al. | |

FOREIGN PATENT DOCUMENTS

| | | | |
|---|---|---|---|
| EP | 1431439 | A1 | 6/2004 |
| KR | 10-2003-0062557 | | 7/2003 |
| KR | 10-2006-0096714 | | 9/2006 |
| KR | 10-2008-0040338 | | 5/2008 |
| KR | 10-2008-0071427 | | 8/2008 |
| WO | WO 2007/126167 | A1 | 11/2007 |

OTHER PUBLICATIONS

Jang et al., KR 1020030062557, Jul. 2003, English machine translation.*
European Search Report for corresponding European Patent Application No. 09168225.2 dated Jan. 13, 2010, 8 pgs (In English).
Korean Office Action mailed Jan. 20, 2015 in related Korean Application No. 10-2008-0088837.

* cited by examiner

*Primary Examiner* — Jason Ko
(74) *Attorney, Agent, or Firm* — Staas & Halsey LLP

(57) ABSTRACT

Disclosed herein is a drum type washing machine including a body, a tub arranged in the body, and a drum rotatably installed in the tub, and an inner surface of a rear wall of the has a flat portion along a rotating direction of the drum.

8 Claims, 7 Drawing Sheets

DRUM TYPE WASHING MACHINE

CROSS-REFERENCE TO RELATED APPLICATION

This application claims the benefit of Korean Patent Application No. 2008-0088837, filed on Sep. 9, 2008 in the Korean Intellectual Property Office, the disclosure of which is incorporated herein by reference.

BACKGROUND

1. Field

Embodiments of the present invention relate to a drum type washing machine having an improved tub configuration.

2. Description of the Related Art

Generally, washing machines carry out washing, rinsing and dehydrating processes, to remove contaminants adhered to laundry using interaction of water and detergent. The washing machines may be classified into a cylindrical drum type, an agitator type, and a pulsator type, based on washing methods thereof.

In a drum type washing machine, structural strength of a tub may be important to support a load of laundry when the laundry is rotated at a high speed along with a drum. To enhance the strength of the tub, a rear wall of the tub has conventionally been fabricated with a complicated convex and concave inner surface.

SUMMARY

Therefore, it is an aspect of the present invention to provide a drum type washing machine, a tub of which has an improved configuration to reduce aerodynamic noise and bio-films and to enhance tub strength.

Additional aspects and/or advantages will be set forth in part in the description which follows and, in part, will be apparent from the description, or may be learned by practice of the invention.

The foregoing and/or other aspects of the present invention may be achieved by providing a drum type washing machine including a body, a tub arranged in the body, and a drum rotatably installed in the tub, and an inner surface of a rear wall of the tub has a flat portion in a rotating direction of the drum.

The drum type washing machine may further include a bearing housing insert-molded in the rear wall of the tub.

The inner surface of the rear wall of the tub may include a region corresponding to the bearing housing insert-molded in the rear wall of the tub, and the region may have no convex or concave portion in the rotating direction of the drum.

The inner surface of the rear wall of the tub may include a reinforcing portion extending in the rotating direction of the drum. The reinforcing portion may be formed at the outside of the region. An outer surface of the rear wall of the tub may include reinforcing ribs. The reinforcing ribs may include a plurality of straight ribs radially extending from a center of the tub. The tub may have a cylindrical shape, and the reinforcing ribs may include a plurality of concentric circular ribs having the same common center as that of the tub. A rear surface of the bearing housing may include reinforcing members having a shape corresponding to the reinforcing ribs of the tub.

The drum type washing machine may further include a shaft connected to the drum through a center of the rear wall of the tub and rotating the drum, and the inner surface of the rear wall of the tub may be gently curved upward from an outer rim of the tub to a center of the tub, thus being centrally raised.

The bearing housing may include a plurality of holes.

The foregoing and/or another aspects of the present invention are also achieved by providing a drum type washing machine including a tub having a rear wall, a drum rotatably arranged in the tub, and a bearing housing contained in the rear wall of the tub, and an inner surface of the rear wall of the tub includes a first region corresponding to the bearing housing, and a second region around the first region, and the first region is a planar region.

The rear wall of the tub may include a reinforcing portion formed in the second region.

The tub may have a cylindrical shape, and the reinforcing portion may protrude from the inner surface of the rear wall of the tub and extend in a circumferential direction of the rear wall of the tub.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
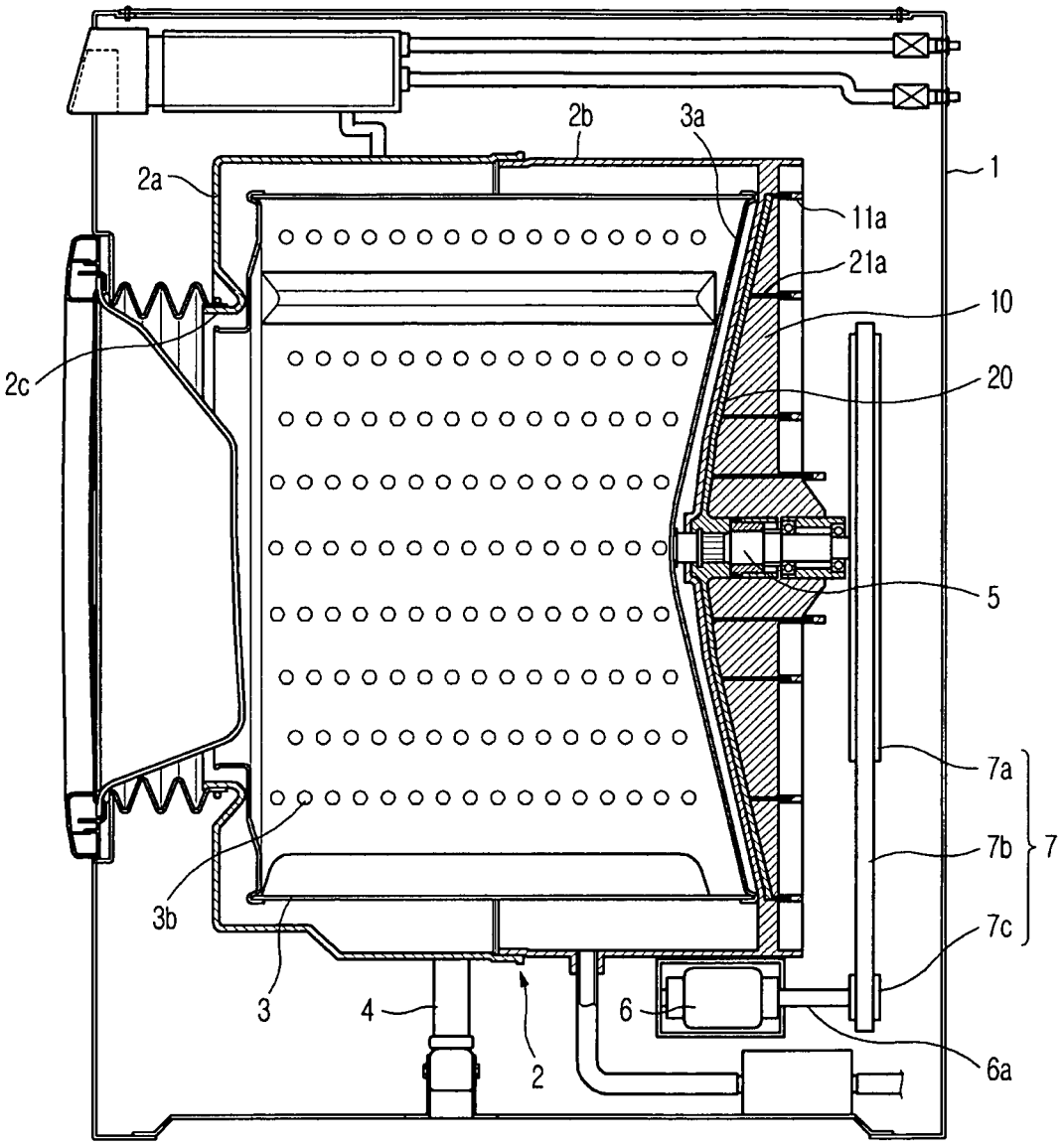
FIG. 1 is a sectional view illustrating a drum type washing machine according to a first embodiment of the present invention.

Reference will now be made in detail to the embodiments, examples of which are illustrated in the accompanying drawings, wherein like reference numerals refer to like elements throughout. The embodiments are described below to explain the present invention by referring to the figures.

Figure 2:
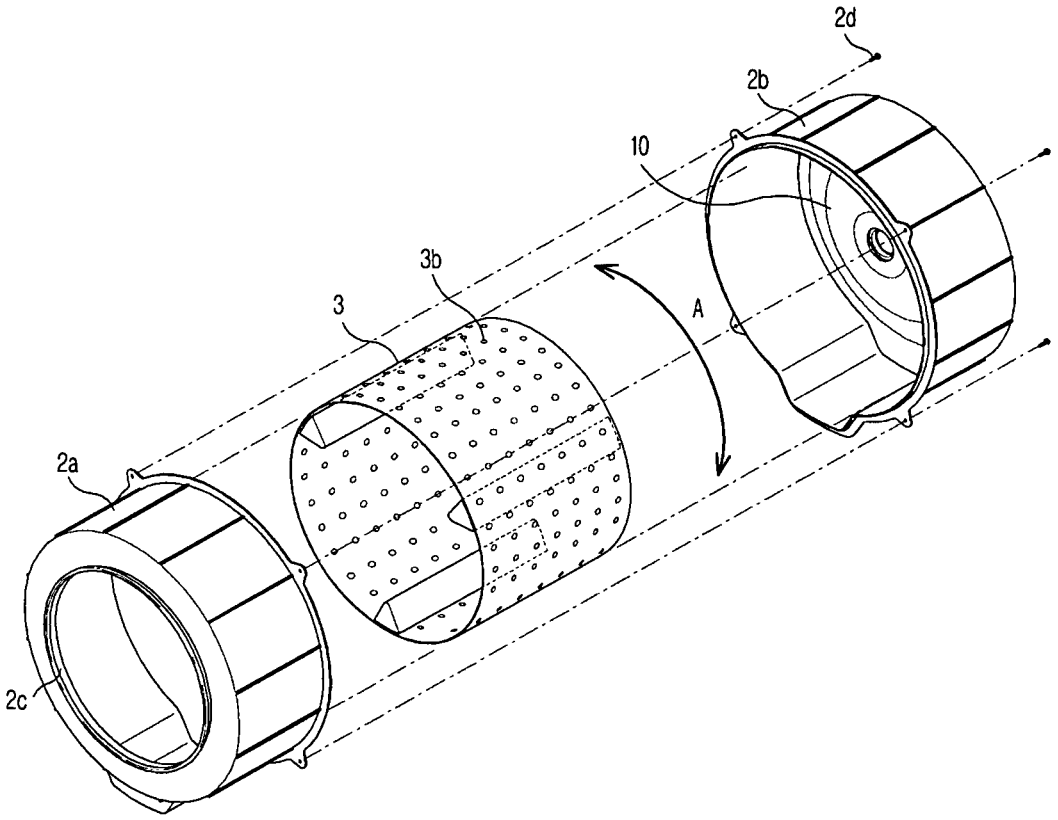
FIG. 2 is an exploded perspective view of a tub provided in the drum type washing machine according to the embodiment of FIG. 1.

FIG. 1 is a sectional view illustrating a drum type washing machine according to one embodiment of the present invention, and FIG. 2 is an exploded perspective view of a tub provided in the drum type washing machine according to the embodiment of FIG. 1.

The drum type washing machine includes a cabinet 1 defining an external appearance of the drum type washing machine, a tub 2 installed in the cabinet 1 in a shock-absorbing manner using a damper 4, a drum 3 rotatably disposed in the tub 2 and having dehydrating holes 3*b* perforated in a peripheral surface thereof, a shaft 5 connected to the drum 3 through the center of a rear wall 10 of the tub 2 and serving to rotate the drum 3, a motor 6 mounted underneath the tub 2, and a power transmission device 7 to transmit drive force of the motor 6 to the shaft 5.

The power transmission device 7 includes a driving pulley 7*c* fixed to a rotating shaft 6*a* of the motor 6, a driven pulley 7*a* fixed to the shaft 5, and a belt 7*b* to link the driving pulley 7*c* and driven pulley 7*a* with each other. The driving pulley 7*c* takes the form of a hollow cylinder and is fixed to a distal end of the rotating shaft 6*a*. The driven pulley 7*a* is fixed to a distal end of the shaft 5 penetrating the rear wall 10 of the tub 2.

The tub 2 has a cylindrical shape and includes a front tub 2*a* and a rear tub 2*b* coupled to each other using bolts 2*d*. The front tub 2*a* has an opening 2*c* for entrance and exit of laundry, and the shaft 5 penetrates through the rear tub 2*b*.

An inner surface of the rear wall 10 of the tub 2 is gently curved upward from the outer rim to the center of the rear wall 10 of the tub 2, thus being centrally raised. In addition, a rear wall 3*a* of the drum 3 is centrally raised to correspond to the inner surface of the rear wall 10 of the tub 2. The center of the rear wall 10 of the tub 2 is raised to have an increased center thickness to stably support the shaft 5 that penetrates through the center of the rear wall 10 of the tub 2 and is affected by load of the drum 3.

The inner surface of the rear wall 10 of the tub 2 is a smooth surface having no convex or concave portions in a rotating direction A of the drum 3. In other words, the inner surface has flat portions. Specifically, since the inner surface of the rear wall 10 of the tub 2 has no convex or concave portion in a circumferential direction of the tub 2 corresponding to the rotating direction A of the drum 3, air moving between the rear wall 3*a* of the drum 3 and the rear wall 10 of the tub 2 during high-speed dehydrating rotation of the drum 3 may cause only slight pressure variation. This results in reduced noise. Moreover, the smooth inner surface of the rear wall 10 of the tub 2 may restrict generation of contaminants due to wash water, such as bio-films, etc.

Figure 4:
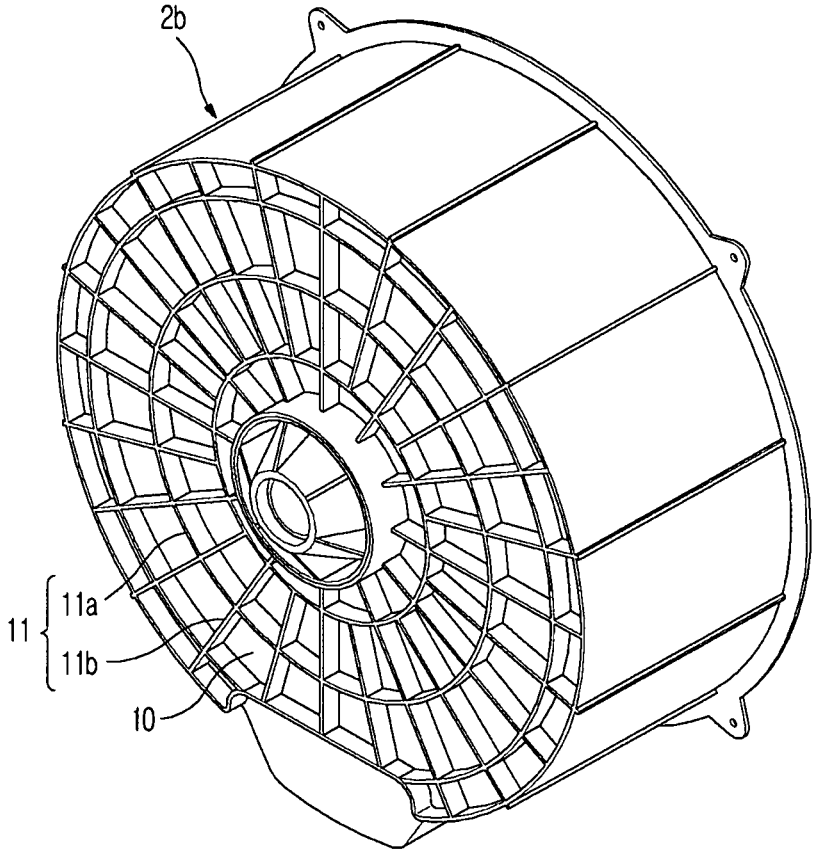
FIG. 4 is a rear perspective view of the tub provided in the drum type washing machine according to the embodiment of FIG. 1.

An outer surface of the rear wall 10 of the tub 2 is provided with reinforcing ribs 11 (see FIG. 4). The reinforcing ribs 11 include a plurality of circular ribs 11*a* and a plurality of straight ribs 11*b* (see FIG. 4). In the present embodiment, the reinforcing ribs 11 are provided at the outer surface of the rear wall 10 of the tub 2 to enhance structural strength of the tub 2, instead of omitting a conventional convex and concave inner surface of the rear wall of the tub.

To further enhance the structural strength of the tub 2, a metallic bearing housing 20 is formed in a shape corresponding to the rear wall 10 of the tub 2 and is insert-molded into the rear wall 10 of the tub 2.

The bearing housing 20 is gently curved upward from the outer rim to the center of the bearing housing 20 thus being centrally raised, and is similar to the inner surface of the rear wall 10 of the tub 2. A front surface of the bearing housing 20 is a smooth surface similar to the inner surface of the rear wall 10 of the tub 2, and a rear surface of the bearing housing 20 is provided with reinforcing members 21 (see FIG. 6) corresponding to the reinforcing ribs 11 of the tub 2. The reinforcing members 21 of the bearing housing 20 include a plurality of circular members 21*a* and a plurality of straight members 21*b* (see FIG. 6).

Figure 3:
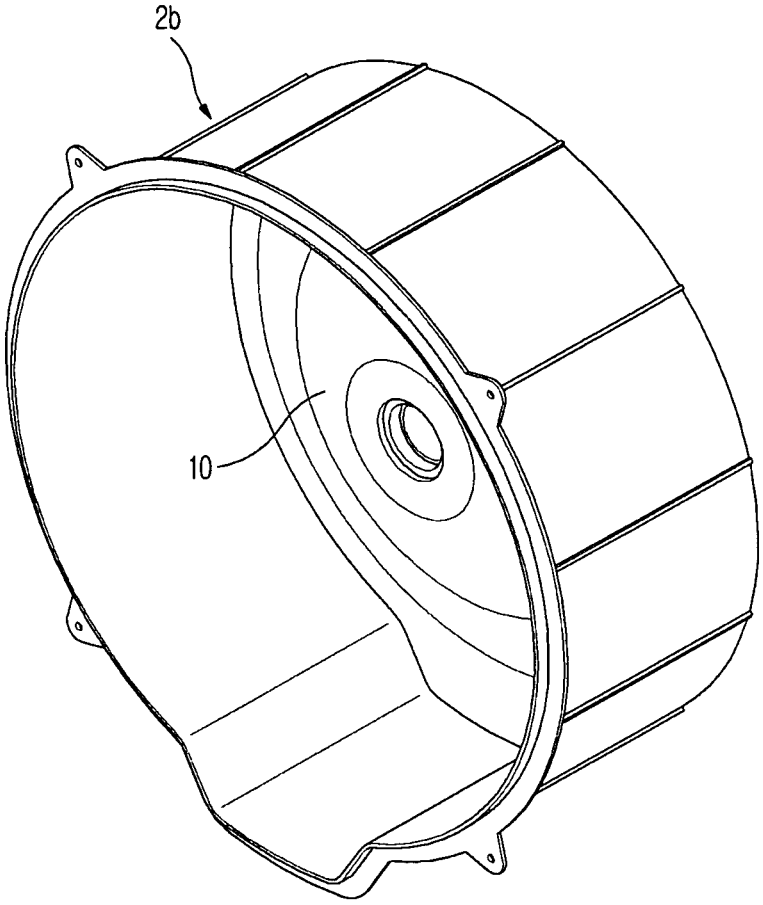
FIG. 3 is a front perspective view of the tub provided in the drum type washing machine according to the embodiment of FIG. 1.

FIG. 3 is a front perspective view of the tub provided in the drum type washing machine according to the first embodiment of the present invention, and FIG. 4 is a rear perspective view of the tub provided in the drum type washing machine according to the first embodiment of the present invention.

As shown in FIG. 3, the inner surface of the rear wall 10 of the tub 2 has no convex or concave portion in the circumferential direction of the tub 2 equal to the rotating direction A of the drum 3, and entirely defines a smooth surface gently curved radially toward the center of the tub 2. This configuration of the tub 2 is proposed not only to reduce pressure variation caused by air moving between the rear wall 3*a* of the drum 3 and the inner surface of the rear wall 10 of the tub 2 during high-speed dehydrating rotation of the drum 3. This also achieves reduced aerodynamic noise, and still further stably supports the shaft 5 connected to the drum 3 through the center of the rear wall 10 of the tub 2.

Therefore, as shown in FIG. 4, the reinforcing ribs 11 are provided at the outer surface of the rear wall 10 of the tub 2, to assure the strength of the tub 2 despite the smooth inner surface of the rear wall 10 of the tub 2.

The reinforcing ribs 11 include the plurality of concentric circular ribs 11*a* of different sizes having the same common center as the center of the rear wall 10 of the tub 2, and the plurality of straight ribs 11*b* radially extending from the center of the rear wall 10 of the tub 2. Providing the outer surface of the rear wall 10 of the tub 2 with the reinforcing ribs 11 may increase bending strength of the rear wall 10 of the tub 2.

Figure 5:
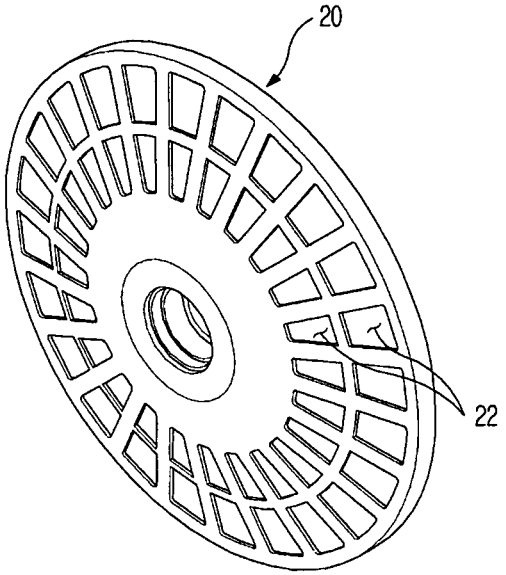
FIG. 5 is a front perspective view of a bearing housing provided in the drum type washing machine according to the embodiment of FIG. 1.
Figure 6:
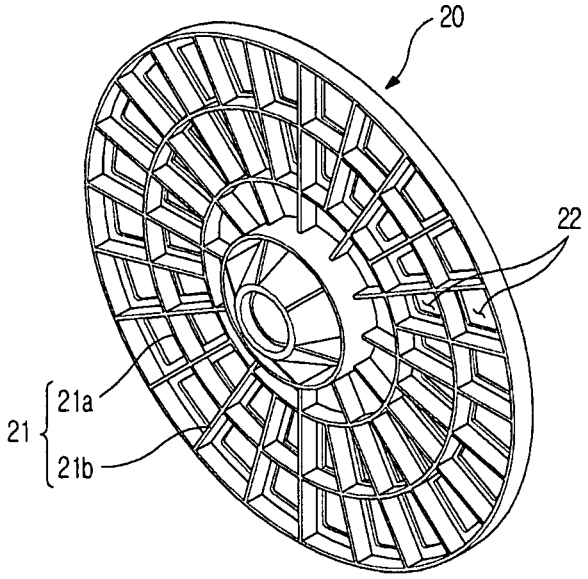
FIG. 6 is a rear perspective view of the bearing housing provided in the drum type washing machine according to the embodiment of FIG. 1.

FIG. 5 is a front perspective view of the bearing housing provided in the drum type washing machine according to the first embodiment of the present invention, and FIG. 6 is a rear perspective view of the bearing housing provided in the drum type washing machine according to the present embodiment.

Referring to FIGS. 5 and 6, the bearing housing 20 is formed of a metal, such as aluminum. The bearing housing 20 is formed in a shape corresponding to the rear wall 10 of the tub 2 and is insert-molded into the rear wall 10 of the tub 2, in order to support the shaft 5 and also, to increase strength of the rear wall 10 of the tub 2.

Accordingly, the front surface of the bearing housing 20 is a smooth surface having no convex or concave portions, similar to the rear wall 10 of the tub 2, and the rear surface of the bearing housing 20 is formed with the reinforcing members 21 including the circular members 21*a* and the straight members 21*b*.

The bearing housing 20 is centrally raised to correspond to the center of the rear wall 10 of the tub 2. A plurality of holes 22 are circumferentially perforated in the bearing housing 20 between the circular members 21*a* and the straight members 21*b*, to allow resin to be smoothly charged into the rear wall 10 of the tub 2 during insert-molding of the bearing housing 20.

Figure 7:
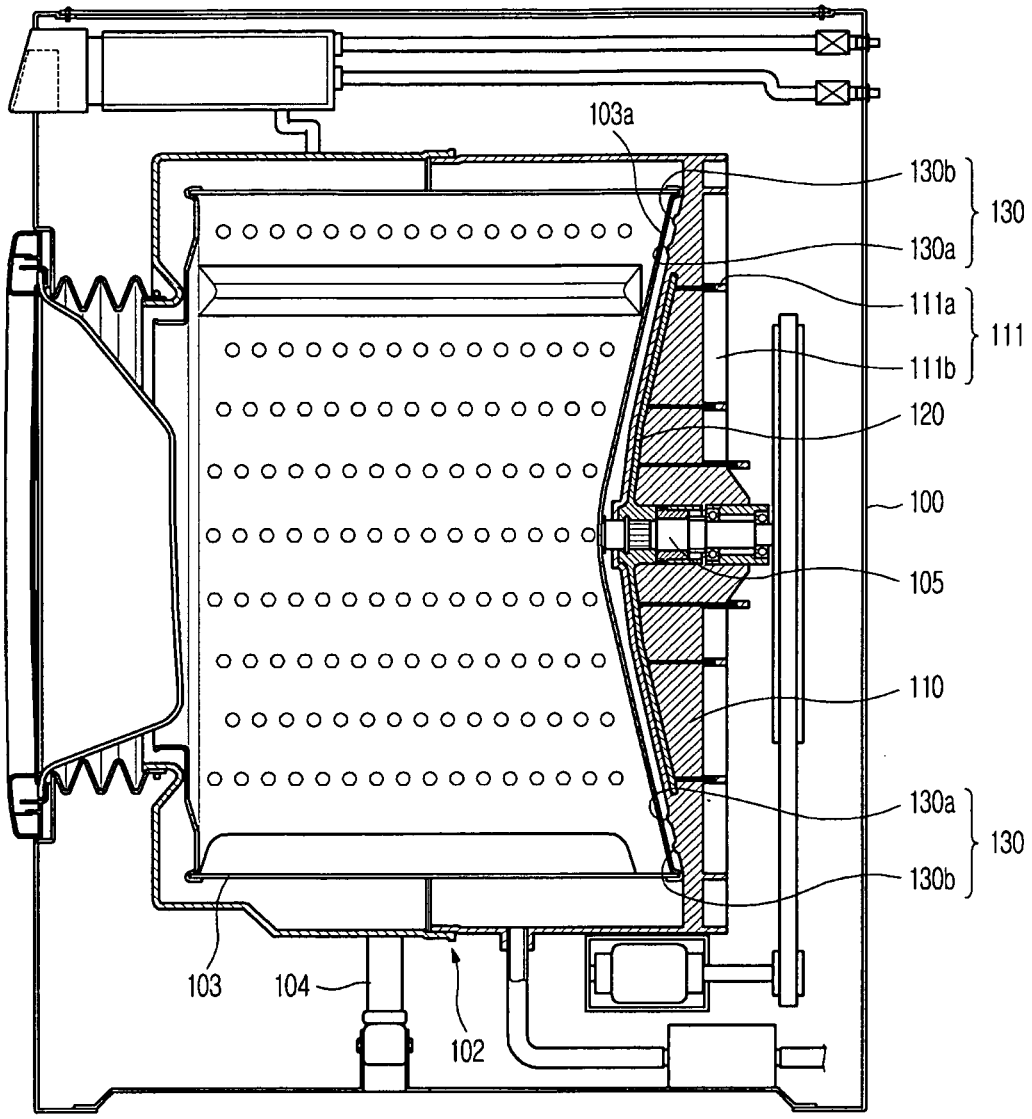
FIG. 7 is a sectional view illustrating a drum type washing machine according to a second embodiment of the present invention.
Figure 8:
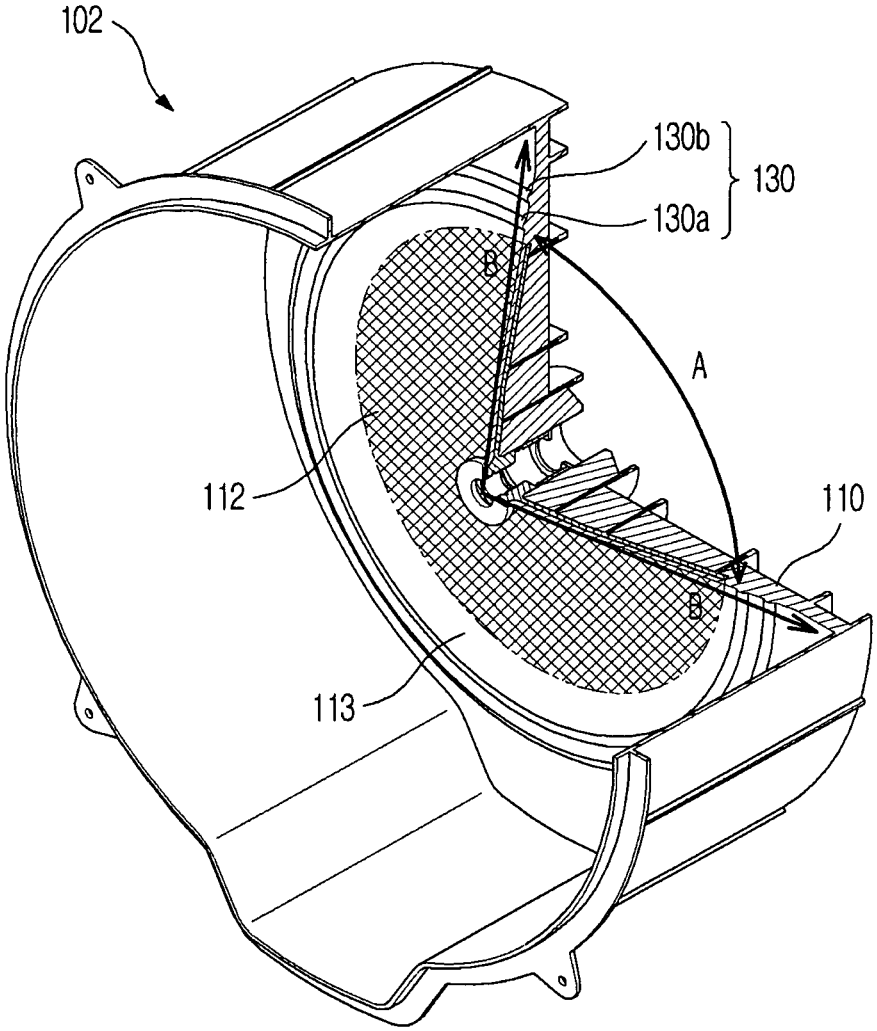
FIG. 8 is a partial sectional perspective view of a tub provided in the drum type washing machine according to the embodiment of FIG. 7.

FIG. 7 is a sectional view illustrating a drum type washing machine according to a second embodiment of the present invention, and FIG. 8 is a partial sectional perspective view of a tub provided in the drum type washing machine according to the embodiment of FIG. 7.

Hereinafter, a description of the same configurations as those of the drum type washing machine according to the first embodiment shown in FIG. 1 will be omitted.

Referring to FIGS. 7 and 8, the drum type washing machine according to the present embodiment includes a cabinet 100 defining an external appearance of the drum type washing machine, a tub 102 installed in the cabinet 100 in a shock-absorbing manner using a damper 104, a drum 103 rotatably disposed in the tub 102, and a shaft 105 connected to the drum 103 through the center of a rear wall 110 of the tub 102 and serving to rotate the drum 103.

An inner surface of the rear wall 110 of the tub 102 is gently curved thus being centrally raised, to stably support the shaft 105. A bearing housing 120 is insert-molded into the rear wall 110 of the tub 102, to reinforce the tub 102. The bearing housing 120 is smaller than the rear wall 110 of the tub 102, and is gently curved thus being centrally raised to correspond to the inner surface of the rear wall 110 of the tub 102.

In a state wherein the bearing housing 120 is insert-molded in the rear wall 110 of the tub 102, a region 112 of the inner surface of the rear wall 110 of the tub 102 corresponding to the bearing housing 120 may define a smooth region, whereas an outer rim region 113 of the inner surface not containing the bearing housing 120 may be formed with reinforcing portions 130 to reinforce the tub 102.

The reinforcing portions 130 include a first reinforcing portion 130*a* and a second reinforcing portion 130*b*, which extend lengthwise in a circumferential direction of the tub 102. The first and second reinforcing portions 130*a* and 130*b* protrude forward from the inner surface of the rear wall 110 of the tub 102, to have a semi-circular shape.

The reinforcing portions 130 reinforce the rear wall 110 of the tub 102, more particularly, the outer rim region 113 of the rear wall 100 of the tub 102 which does not contain the bearing housing 120 and has a smaller thickness than the center of the rear wall 110 of the tub 102. Thus, the tub 102 has a reinforced structure by the reinforcing portions 130 formed at the inner surface of the rear wall 110 and reinforcing ribs 111 including circular ribs 111*a* and straight ribs 111*b* formed at an outer surface of the rear wall 110 of the tub 102.

The entire inner surface of the rear wall 110 of the tub 102 has a plan or slope having no convex or concave portions in the rotating direction A of the drum 103. This is because the reinforcing portions 130 are formed in the circumferential direction of the tub 102 corresponding to the rotating direction A of the drum 103.

Now, how the entire inner surface of the rear wall 110 of the tub 102 may be planar without any convex or concave portions in the rotating direction A of the drum 103 will be described with reference to FIG. 8. The reinforcing portions 130 naturally provide the outer rim region 113 of the tub 102 with a convex and concave portion with respect to a radial direction B of the tub 102.

However, the reinforcing portions 130 protrude in the rotating direction A of the drum 103 from the outer rim region 113 of the tub 102 to have a predetermined semi-circular shape and therefore, define no convex or concave portions with respect to the rotating direction A of the drum 103. Accordingly, the reinforcing portions 130 exert no resistance on the flow of air caused between a rear wall 103*a* of the drum 103 and the rear wall 110 of the tub 102 during rotation of the drum 103.

Consequently, the reinforcing portions 130 further reinforce the tub 102 and also, reduce pressure variation due to the flow of air between the rear wall 103*a* of the drum 103 and the rear wall 110 of the tub 102, thus achieving reduced aerodynamic noise.

As is apparent from the above description, a drum type washing machine according to the embodiments of the present invention may achieve reduced aerodynamic noise between a rear wall of a tub and a rear wall of a drum and enhanced structural strength of the tub while reducing generation of any contaminants, such as bio-films, at an inner surface of the rear wall of the tub.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A drum type washing machine comprising:

a body;

a tub arranged in the body;

a drum rotatably installed in the tub; and a bearing housing insert-molded into a rear wall of the tub, wherein an inner surface of the rear wall of the tub has a first portion that has no convex nor concave shape in a rotating direction of the drum where the bearing housing is insert-molded, and a second portion formed as an outer rim with reinforcing portions outside of the first portion where the bearing housing is insert-molded, wherein an outer surface of the rear wall of the tub includes a plurality of concentric circular ribs having a common center as a center of the tub, and a plurality of linear ribs radially extending from the center of the tub, and the bearing housing includes rib-shaped reinforcing members formed in a shape corresponding to the plurality of concentric circular ribs and the plurality of linear ribs, wherein the reinforcing portions have a curved shape and protrude forward from the second portion of the inner surface of the rear wall of the tub in a circumferential direction of the tub to directly face the drum with no intervening structure, so as to reduce resistance on a flow of air between a rear wall of the drum and the rear wall of the tub during rotation of the drum.

2. The drum type washing machine according to claim 1, wherein:

the tub has a cylindrical shape, and the plurality of concentric circular ribs are reinforcing ribs.

3. The drum type washing machine according to claim 2, wherein the rib-shaped reinforcing members are formed on a rear surface of the bearing housing.

4. The drum type washing machine according to claim 1, further comprising a shaft connected to the drum through a center of the rear wall of the tub and serving to rotate the drum.

5. The drum type washing machine according to claim 1, wherein the bearing housing defines a plurality of holes.

6. The drum type washing machine according to claim 1, wherein a front surface of the bearing housing has a smooth surface having no convex or concave portions.

7. A drum type washing machine comprising:

a tub having a rear wall;

a drum rotatably arranged in the tub; and a bearing housing contained in the rear wall of the tub, wherein an inner surface of the rear wall of the tub includes a first region corresponding to the bearing housing, and a second region around the first region formed with reinforcing protrusions, and the first region is a region that has no convex nor concave shape in a rotating direction of the drum where the bearing housing is insert-molded, and wherein an outer surface of the rear wall of the tub includes a reinforcing portion formed in the second region, wherein the reinforcing portion protrudes from the inner surface of the rear wall of the tub and include a plurality of concentric circular ribs having a common center as a center of the tub, and a plurality of linear ribs radially extending from the center of the tub, and the bearing housing includes rib-shaped reinforcing members formed in a shape corresponding to the plurality of concentric circular ribs and the plurality of linear ribs, wherein the reinforcing protrusions have a curved shape and protrude forward from the inner surface of the rear wall of the tub in a circumferential direction of the tub to directly face the drum with no intervening structure, so as to reduce resistance on a flow of air between a rear wall of the drum and the rear wall of the tub during rotation of the drum.

8. The drum type washing machine according to claim 7, wherein:

the tub has a cylindrical shape, and the reinforcing portion extends in a circumferential direction of the rear wall of the tub.

* * * * *